US010400500B2

(12) United States Patent
Tachibana

(10) Patent No.: US 10,400,500 B2
(45) Date of Patent: Sep. 3, 2019

(54) VEHICLE CONTROL DEVICE AND VEHICLE CONTROL METHOD

(71) Applicant: TOYOTA JIDOSHA KABUSHIKI KAISHA, Toyota-shi, Aichi-ken (JP)

(72) Inventor: Katsuharu Tachibana, Nagoya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/031,924

(22) Filed: Jul. 10, 2018

(65) Prior Publication Data

US 2019/0048646 A1 Feb. 14, 2019

(30) Foreign Application Priority Data

Aug. 9, 2017 (JP) ..... 2017-154579

(51) Int. Cl.
*E05F 15/76* (2015.01)
*E05F 15/40* (2015.01)
*E05F 15/77* (2015.01)

(52) U.S. Cl.
CPC ..... *E05F 15/76* (2015.01); *E05F 15/40* (2015.01); *E05F 15/77* (2015.01); *E05Y 2400/664* (2013.01); *E05Y 2900/532* (2013.01)

(58) Field of Classification Search
CPC ..... E05F 15/76; E05F 15/40
USPC ..... 340/5.72
See application file for complete search history.

(56) References Cited

U.S. PATENT DOCUMENTS

2006/0244312 A1* 11/2006 Ogino ..... B60R 25/257 307/9.1
2009/0030579 A1 1/2009 Takehisa
2016/0208537 A1* 7/2016 Senguttuvan ..... B60W 50/0098

FOREIGN PATENT DOCUMENTS

JP 2009-024454 A 2/2009

* cited by examiner

*Primary Examiner* — Vernal U Brown
(74) *Attorney, Agent, or Firm* — Oliff PLC

(57) ABSTRACT

A vehicle control device that controls automatic opening and closing of a vehicle door includes an estimation unit configured to estimate a position of a portable terminal that is authenticated by a vehicle through predetermined communication, a determination unit configured to determine whether the position of the portable terminal estimated by the estimation unit is within a region where the vehicle door passes in an opening and closing operation, and a controller configured to, when door opening or door closing of the vehicle door is instructed, in a case where the determination unit determines that the position of the portable terminal is not within the region, execute the opening and closing operation of the vehicle door.

13 Claims, 7 Drawing Sheets

[SIDE VIEW]

[TOP VIEW (EXCLUDING BACK DOOR)]

VEHICLE CONTROL DEVICE AND VEHICLE CONTROL METHOD

INCORPORATION BY REFERENCE

The disclosure of Japanese Patent Application No. 2017-154579 filed on Aug. 9, 2017 including the specification, drawings and abstract is incorporated herein by reference in its entirety.

BACKGROUND

1. Technical Field

The present disclosure relates to a vehicle control device that controls automatic opening and closing of a vehicle door and a vehicle control method that the device executes.

2. Description of Related Art

For example, Japanese Unexamined Patent Application Publication No. 2009-024454 (JP 2009-024454 A) discloses a control device capable of electrically and automatically opening a vehicle door (for example, a back door) only by the approach of a user to a vehicle in a case where automatic door opening is reserved in advance to vehicle side equipment.

In the control device of the related art described in JP 2009-024454 A, in a case where a portable terminal (electronic key, smartphone, or the like) carried by the user is authenticated by the vehicle side equipment, the door opening operation of the vehicle door is automatically started. For this reason, in a case where the user excessively approaches the vehicle after authentication is completed, the user may come into contact with the vehicle door during the door opening operation.

As a countermeasure for avoiding the contact between the user and the vehicle door, in the control device of the related art, in a case where advance reservation of automatic door opening is received, a communication area where authentication processing with the portable terminal is possible is expanded, thereby completing authentication before the user excessively approaches the vehicle and starting the door opening operation of the vehicle door.

SUMMARY

However, even in the countermeasure for avoiding the contact between the user and the vehicle door using the control device of the related art, it is not possible to ascertain movement of the user after the door opening operation of the vehicle door is started. For this reason, the user may come into contact with the vehicle door in the middle of the door opening operation of the vehicle door. Accordingly, there is room for further improvement in automatic opening and closing control of the vehicle door.

The disclosure provides a vehicle control device and a vehicle control method with improved performance of avoiding contact between a vehicle door performing an automatic opening and closing operation and a user.

A first aspect of the disclosure relates to a vehicle control device that controls automatic opening and closing of a vehicle door. The vehicle control device includes an estimation unit, a determination unit, and a controller. The estimation unit is configured to estimate a position of a portable terminal that is authenticated by a vehicle through predetermined communication. The determination unit is configured to determine whether or not the position of the portable terminal estimated by the estimation unit is within a region where the vehicle door passes in an opening and closing operation. The controller is configured to, when door opening or door closing of the vehicle door is instructed, in a case where the determination unit determines that the position of the portable terminal is not within the region, execute the opening and closing operation of the vehicle door.

In the vehicle control device according to the first aspect of the disclosure, the position of the portable terminal that is authenticated by the vehicle and is present around the vehicle is estimated. When the vehicle door is automatically opened and closed, in a case where the position of the portable terminal is not within the region where the vehicle door passes in the opening and closing operation, the opening and closing operation of the vehicle door is executed.

In the control, the opening and closing operation of the vehicle door is executed based on determination that the user who carries the portable terminal is not also within the region in a case where the portable terminal is not within the region. Accordingly, it is possible to suppress the contact of the vehicle door with the user who carries the portable terminal.

In the vehicle control device according to the first aspect of the disclosure, the controller may be configured to, when door opening or door closing of the vehicle door is instructed, in a case where the determination unit determines that the position of the portable terminal is within the region and has a predetermined positional relationship with the vehicle door, execute the opening and closing operation of the vehicle door at a speed lower than in a case where the determination unit determines that the position of the portable terminal is not within the region.

In the control, even though the portable terminal is within the region, that is, even though the user who carries the portable terminal is within the region where the user comes into contact with the vehicle door, the opening and closing operation of the vehicle door is performed at a speed lower than normal. With this, even though the user who carries the portable terminal is within the region at the time of the start of the opening and closing operation of the vehicle door, the user who notices the approach of the vehicle door during the opening and closing operation can take action for avoiding the contact with the vehicle door with sufficient time. Accordingly, it is possible to suppress the contact of the vehicle door in the opening and closing operation with the user who carries the portable terminal.

In the vehicle control device according to the first aspect of the disclosure, the predetermined positional relationship may be a positional relationship where there is a given margin before the vehicle door comes into contact with the portable terminal.

In the vehicle control device according to the first aspect of the disclosure, the controller may be configured to, when door opening or door closing of the vehicle door is instructed, in a case where the determination unit determines that the position of the portable terminal is within the region and has a predetermined positional relationship with the vehicle door, perform predetermined notification through a notification unit mounted in the vehicle or instruct the portable terminal to perform predetermined notification.

With the control, it is possible to alert the user that the user is at a position where the user comes into contact with the vehicle door in the opening and closing operation. With this, it is possible to allow the user to take action for avoiding the contact with the vehicle door. Accordingly, when the opening and closing operation of the vehicle door is performed afterwards, it is possible to suppress the contact of the user who carries the portable terminal with the vehicle door in the opening and closing operation.

In the vehicle control device according to the first aspect of the disclosure, the estimation unit may be configured to further estimate movement of the portable terminal based on time-dependent change in the position of the portable terminal. The determination unit may be configured to further determine whether or not movement of the vehicle door of which opening and closing operation is started by the controller interferes with the movement of the portable terminal estimated by the estimation unit. The controller may be configured to, in a case where the determination unit determines that the movement of the vehicle door and the movement of the portable terminal interfere with each other, stop the opening and closing operation of the vehicle door.

With the control, in a period from the start of the opening and closing operation of the vehicle door to the completion thereof, in a case where the user who carries the portable terminal and the vehicle door interfere with each other, for example, in a case where an opening and closing direction of the vehicle door and a moving direction of the user have an intersecting relationship, it is possible to stop the opening and closing operation of the vehicle door. With this, it is possible to suppress the contact of the user who carries the portable terminal with the vehicle door in the opening and closing operation.

The vehicle control device according to the first aspect of the disclosure may further include a first communication unit configured to perform communication with the portable terminal for authentication of the portable terminal, and a second communication unit configured to perform communication with the portable terminal for estimation of the position of the portable terminal. The first communication unit may be configured to transmit a request signal requesting for response signal transmission from the portable terminal through low frequency communication and receive a response signal transmitted from the portable terminal through radio frequency communication. The second communication unit may be configured to measure a distance between the second communication unit and the portable terminal through ultra-wideband communication.

In the vehicle control device according to the first aspect of the disclosure, all or a part of the estimation unit, the determination unit, and the controller may be constituted by an electronic control unit.

A second aspect of the disclosure relates to a vehicle control method executed by a vehicle control device that controls automatic opening and closing of a vehicle door. The vehicle control method includes estimating a position of a portable terminal that is authenticated by a vehicle through predetermined communication, determining whether the estimated position of the portable terminal is within a region where the vehicle door passes in an opening and closing operation, and when door opening or door closing of the vehicle door is instructed, in a case where determination is made that the position of the portable terminal is not within the region, executing the opening and closing operation of the vehicle door.

In the vehicle control method according to the second aspect of the disclosure, when door opening or door closing of the vehicle door is instructed, in a case where determination is made that the position of the portable terminal is within the region and has a predetermined positional relationship with the vehicle door, the opening and closing operation of the vehicle door may be executed at a speed lower than in a case where determination is made that the position of the portable terminal is not within the region.

In the vehicle control method according to the second aspect of the disclosure, when door opening or door closing of the vehicle door is instructed, in a case where determination is made that the position of the portable terminal is within the region and has a predetermined positional relationship with the vehicle door, predetermined notification may be performed.

In the vehicle control method according to the second aspect of the disclosure, when door opening or door closing of the vehicle door is instructed, in a case where determination is made that the position of the portable terminal is within the region and has a predetermined positional relationship with the vehicle door, the portable terminal may be instructed to perform predetermined notification.

The vehicle control method according to the second aspect of the disclosure may further include estimating movement of the portable terminal based on time-dependent change in the position of the portable terminal, determining whether or not movement of the vehicle door of which opening and closing operation is started interferes with the estimated movement of the portable terminal, and in a case where determination is made that the movement of the vehicle door and the movement of the portable terminal interfere with each other, stopping the opening and closing operation of the vehicle door.

The processing that the vehicle control device performs can be regarded as a vehicle control method that provides a series of processing procedures. The method is provided in the format of a program for causing a computer to execute a series of processing procedures. The program may be installed on a computer in the form of being recorded in a computer-readable recording medium. A part or all of the functional blocks constituting the vehicle control device may be realized as a large scale integration (LSI) that is an integrated circuit.

With the vehicle control device and the vehicle control method according to the aspects of the disclosure, it is possible to improve performance of avoiding the contact between the vehicle door in the automatic opening and closing operation and the user.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Outline

A vehicle control device and a vehicle control method of the disclosure estimates a position of a portable terminal present around the vehicle. When a vehicle door is automatically opened and closed, in a case where the portable terminal is not at a position in contact with the vehicle door in an opening and closing operation, the opening and closing operation of the vehicle door is executed. With this, it is possible to suppress the contact of the vehicle door with a user who carries the portable terminal.

System Configuration

Figure 1:
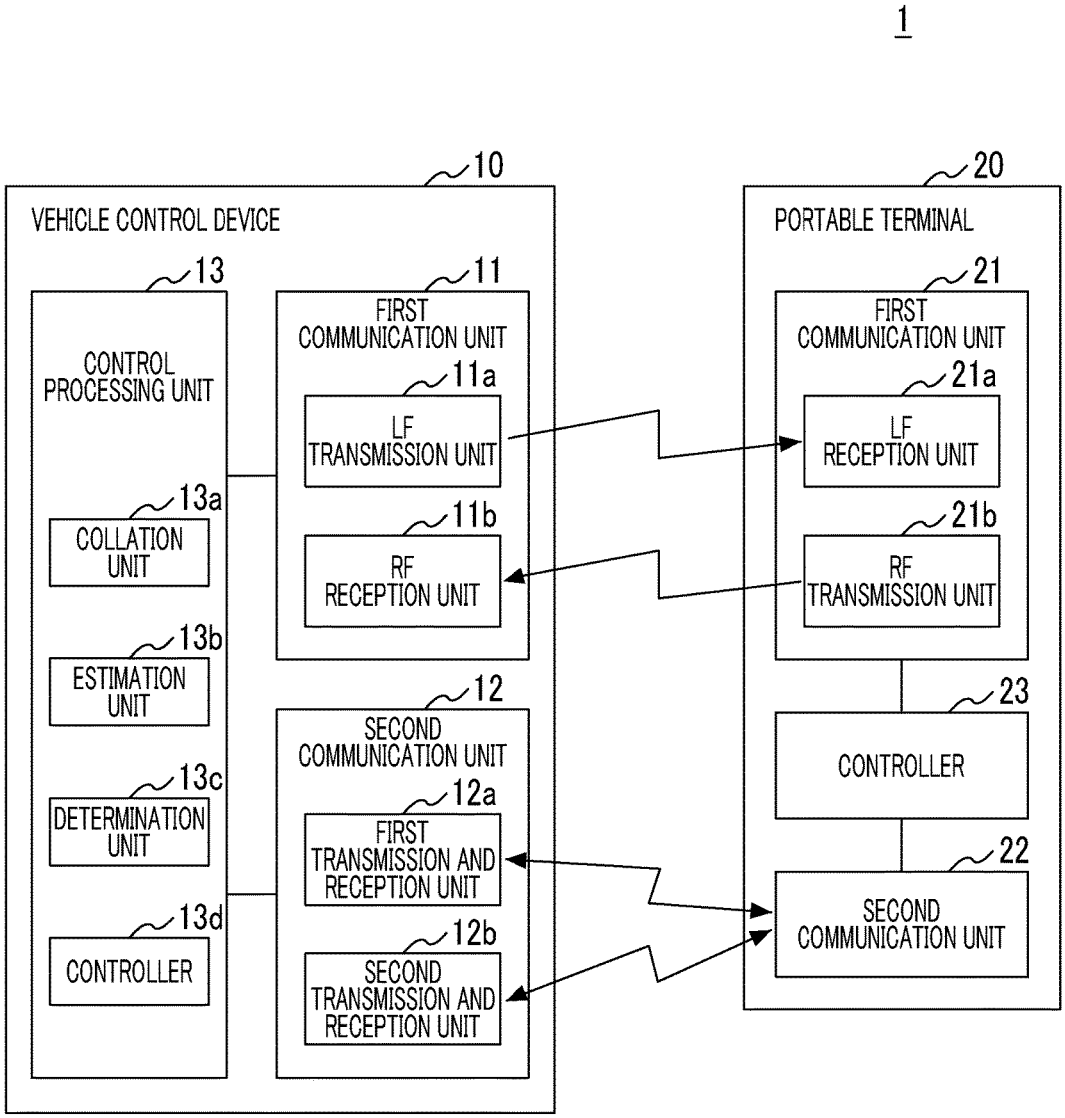
FIG. 1 is a schematic view of a system having a configuration including a vehicle control device according to an embodiment of the disclosure.

FIG. 1 is a diagram illustrating the outline of a vehicle system 1 having a configuration including a vehicle control device 10 according to an embodiment of the disclosure. In FIG. 1, the vehicle system 1 includes the vehicle control device 10 that is provided in the vehicle, and a portable terminal 20 that can be carried by the user or the like.

Figure 2A:
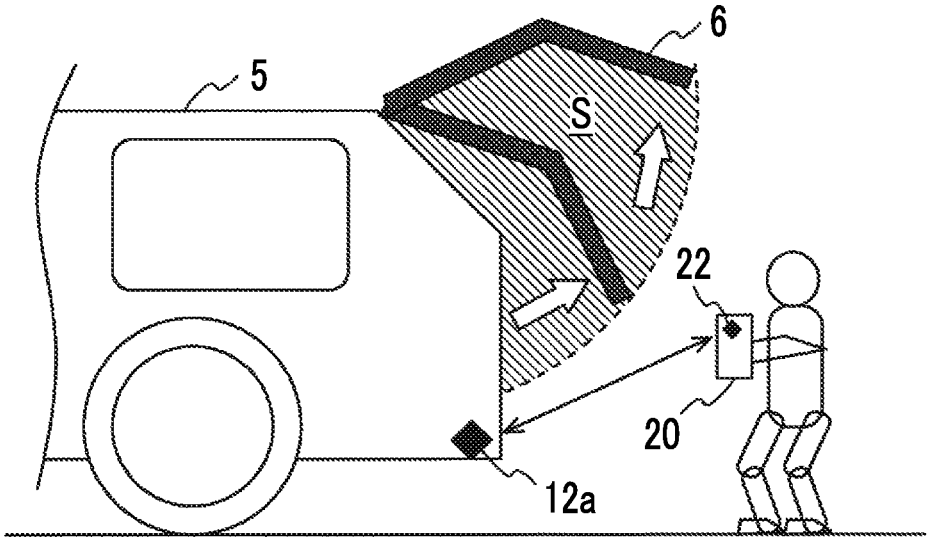
FIG. 2A is a diagram schematically showing a door opening operation example of a vehicle door (back door)
Figure 2A:
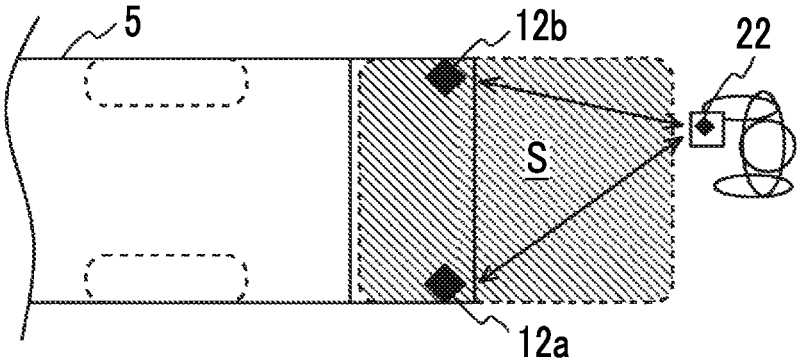
Figure 2B:
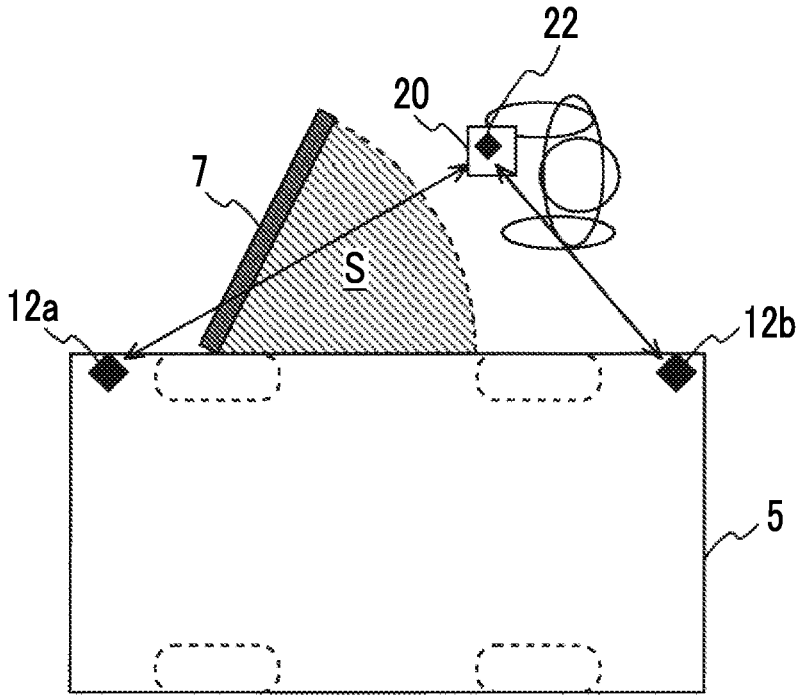
FIG. 2B is a diagram schematically showing a door opening operation example of a vehicle door (front door)

The vehicle in which the vehicle control device 10 is provided is a vehicle including a vehicle door that can be electrically and automatically opened and closed (hereinafter, referred to as an "opening and closing operation"). The vehicle door includes front doors, rear doors, a back door, and the like. FIG. 2A schematically shows a door opening operation example in a case where a vehicle door of a vehicle 5 is a back door 6 (for example, a power back door). FIG. 2B schematically shows a door opening operation example in a case where the vehicle door of the vehicle 5 is a right front door 7 (for example, an automatic swing door).

Configuration of Vehicle Control Device

In FIG. 1, the vehicle control device 10 includes a first communication unit 11, a second communication unit 12, and a control processing unit 13.

The first communication unit 11 is configured to perform predetermined communication with a first communication unit 21 of the portable terminal 20 described below for authentication of the portable terminal 20. The first communication unit 11 includes, for example, a low frequency (LF) transmission unit 11*a* and a radio frequency (RF) reception unit 11*b*.

The LF transmission unit 11*a* can transmit a request signal requesting for transmission of a response signal from the portable terminal 20 present around the vehicle 5 in a predetermined range through a transmission antenna (not shown). For example, the request signal is transmitted in a range of 0.7 m to 1.0 m from the LF transmission unit 11*a* through LF communication.

The RF reception unit 11*b* can receive the response signal transmitted from a first communication unit 21 of the portable terminal 20 described below through a reception antenna (not shown). The response signal includes an identification information ID that is registered in advance uniquely to the portable terminal 20 transmitting the response signal. In a case where the response signal is received from the portable terminal 20, the RF reception unit 11*b* sends the identification information ID included in the response signal to the control processing unit 13.

The second communication unit 12 is configured to perform predetermined communication with a second communication unit 22 of the portable terminal 20 described below for measuring a distance between the second communication unit 12 and the portable terminal 20 and acquiring a relative position (hereinafter, referred to as "the position of the portable terminal 20") between the vehicle and the portable terminal 20. The second communication unit 12 includes, for example, a first transmission and reception unit 12*a* and a second transmission and reception unit 12*b* provided at a predetermined distance. In the example of FIG. 2A or 2B, two transmission and reception units are provided near a bumper.

For the first transmission and reception unit 12*a* and the second transmission and reception unit 12*b*, for example, an ultra-wideband (UWB) transceiver that performs impulse system UWB wireless communication can be used. The impulse UWB communication is a communication system capable of performing distance measurement with high accuracy using an impulse signal having an extremely short time width equal to or less than one nanosecond.

Each of the first transmission and reception unit 12*a* and the second transmission and reception unit 12*b* transmits an impulse UWB signal to the portable terminal 20 present around the vehicle, and receives an impulse UWB signal transmitted as a response from the portable terminal 20 receiving that impulse UWB signal. The first transmission and reception unit 12*a* calculates the distance between the first transmission and reception unit 12*a* and the portable terminal 20 as a first distance measurement value based on an electric wave propagation time of the impulse UWB signal transmitted and received between the first transmission and reception unit 12*a* and the portable terminal 20. The second transmission and reception unit 12*b* calculates the distance between the second transmission and reception unit 12*b* and the portable terminal 20 as a second distance measurement value based on an electric wave propagation time of the impulse UWB signal transmitted and received between the second transmission and reception unit 12*b* and the portable terminal 20. The calculated first distance measurement value and second distance measurement value are sent to the control processing unit 13.

The control processing unit 13 includes a collation unit 13*a*, an estimation unit 13*b*, a determination unit 13*c*, and a controller 13*d*.

The collation unit 13*a* compares and collates the identification information ID received from the first communication unit 11 with the identification information ID registered in advance in the storage unit (not shown), and authenticates the portable terminal 20 transmitting the identification information ID.

The estimation unit 13*b* estimates the position of the portable terminal 20 based on the first distance measurement value calculated by the first transmission and reception unit 12*a* and the second distance measurement value calculated by the second transmission and reception unit 12*b* received from the second communication unit 12. In this embodiment, since the first transmission and reception unit 12*a* and the second transmission and reception unit 12*b* are provided apart from each other, it is possible to detect (position measurement) the position of the portable terminal 20 from the first distance measurement value and the second distance measurement value with high accuracy. In the second communication unit 12, in a case where three or more transmission and reception units are provided in a stereoscopic arrangement, it is possible to further increase detection accuracy.

The estimation unit 13*b* may be configured to store the position of the portable terminal 20 estimated from the distance measurement values and estimate movement of the portable terminal 20 based on time-dependent change (moving trajectory) in position.

The determination unit 13*c* determines, based on the position of the portable terminal 20 received from the second communication unit 12 and a region S where the vehicle door passes in the known opening and closing operation, whether or not the position of the portable terminal 20 is within the region S. The region S is a region surrounded by a rotational shaft (hinge mechanism or the like) of the vehicle door and a moving trajectory of a vehicle door edge in the opening and closing operation, and can be a region orthogonal to the rotational shaft.

The determination unit 13*c* may be configured to determine whether or not movement of the vehicle door of which opening and closing operation is started by the controller 13*d* described below interferes with the estimated movement of the portable terminal 20 using the movement of the portable terminal 20 estimated by the estimation unit 13*b*.

For example, the controller 13*d* drives an electric motor (not shown) to carry out the opening and closing operation of the vehicle door according to an instruction of the opening and closing operation of the vehicle door performed through a switch for opening and closing the vehicle door provided in the vehicle or the portable terminal 20. In this case, the controller 13*d* appropriately controls the opening and closing operation of the vehicle door based on determination in the determination unit 13*c*. The above-described control of the opening and closing operation of the vehicle door will be described below in detail.

The whole or a part of the above-described control processing unit 13 can be constituted as an electronic control unit (ECU) typically including a central processing unit (CPU), a memory, an input/output interface, and the like. The CPU reads and executes a predetermined program stored in the memory, whereby the electronic control unit can realize the functions of the collation unit 13*a*, the estimation unit 13*b*, the determination unit 13*c*, and the controller 13*d*.

Configuration of Portable Terminal

In FIG. 1, the portable terminal 20 includes a first communication unit 21, a second communication unit 22, and a controller 23. Typically, the portable terminal 20 is an electronic key exclusively provided to operate the vehicle.

The first communication unit 21 is configured to perform predetermined communication with the first communication unit 11 of the vehicle control device 10 for authentication of the portable terminal 20 to the vehicle. The first communication unit 21 includes, for example, an LF reception unit 21*a* and an RF transmission unit 21*b*.

The LF reception unit 21*a* can receive the request signal transmitted from the LF transmission unit 11*a* of the vehicle control device 10 through a reception antenna (not shown). In a case where the request signal is received from the vehicle control device 10, the LF reception unit 21*a* notifies the controller 23 that the request signal is received.

In a case where the notification that the request signal is received from the LF reception unit 21*a* is received, the controller 23 instructs the RF transmission unit 21*b* to transmit a response signal including the identification information ID stored in advance in the storage unit (not shown) and allocated uniquely to the portable terminal 20.

The RF transmission unit 21*b* can transmit the response signal including the identification information ID in a predetermined range through a transmission antenna (not shown) according to the instruction from the controller 23. For example, the response signal is transmitted in a range of 20 m to 100 m from the RF transmission unit 21*b* through RF communication.

The second communication unit 22 is configured to perform predetermined communication with the second communication unit 12 of the vehicle control device 10 for measurement of the distance between the vehicle and the portable terminal 20 in cooperation with the vehicle control device 10. For the second communication unit 22, a UWB transceiver that performs the same impulse UWB communication as the second communication unit 12 of the vehicle control device 10 can be used. In a case where an impulse UWB signal is received from the second communication unit 12, the second communication unit 22 returns an impulse UWB signal to be a response.

A smartphone may be used as the portable terminal 20. In this case, as the first communication unit 21 that is used for authentication processing of the portable terminal 20, the use of a Bluetooth (Registered Trademark) communication module is considered; however, a Bluetooth communication module needs to be mounted as the first communication unit 11 of the vehicle control device 10 or a new third communication unit in the vehicle.

Control that Vehicle Control Device Executes

Figure 3:
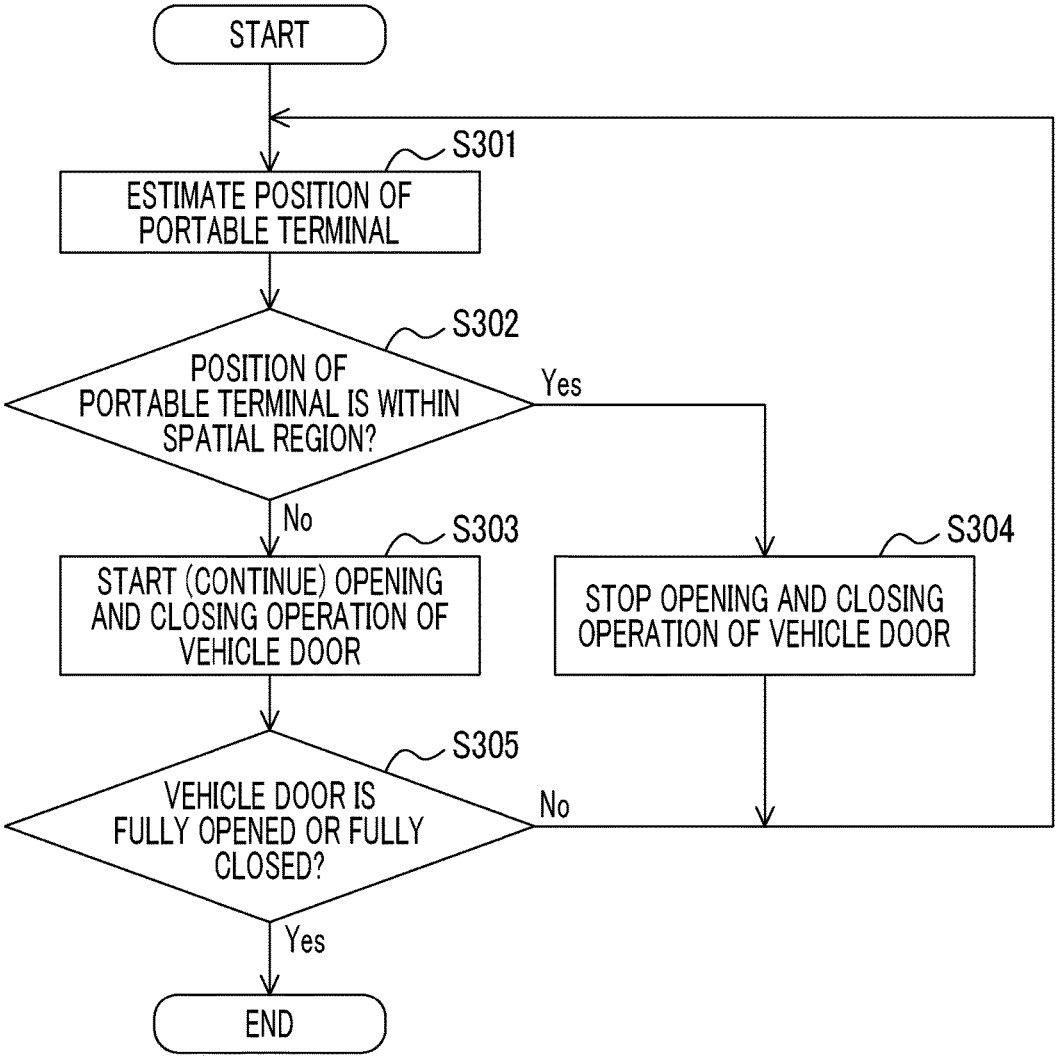
FIG. 3 is a flowchart illustrating a processing procedure of opening and closing control of a vehicle door according to Example 1.
Figure 4:
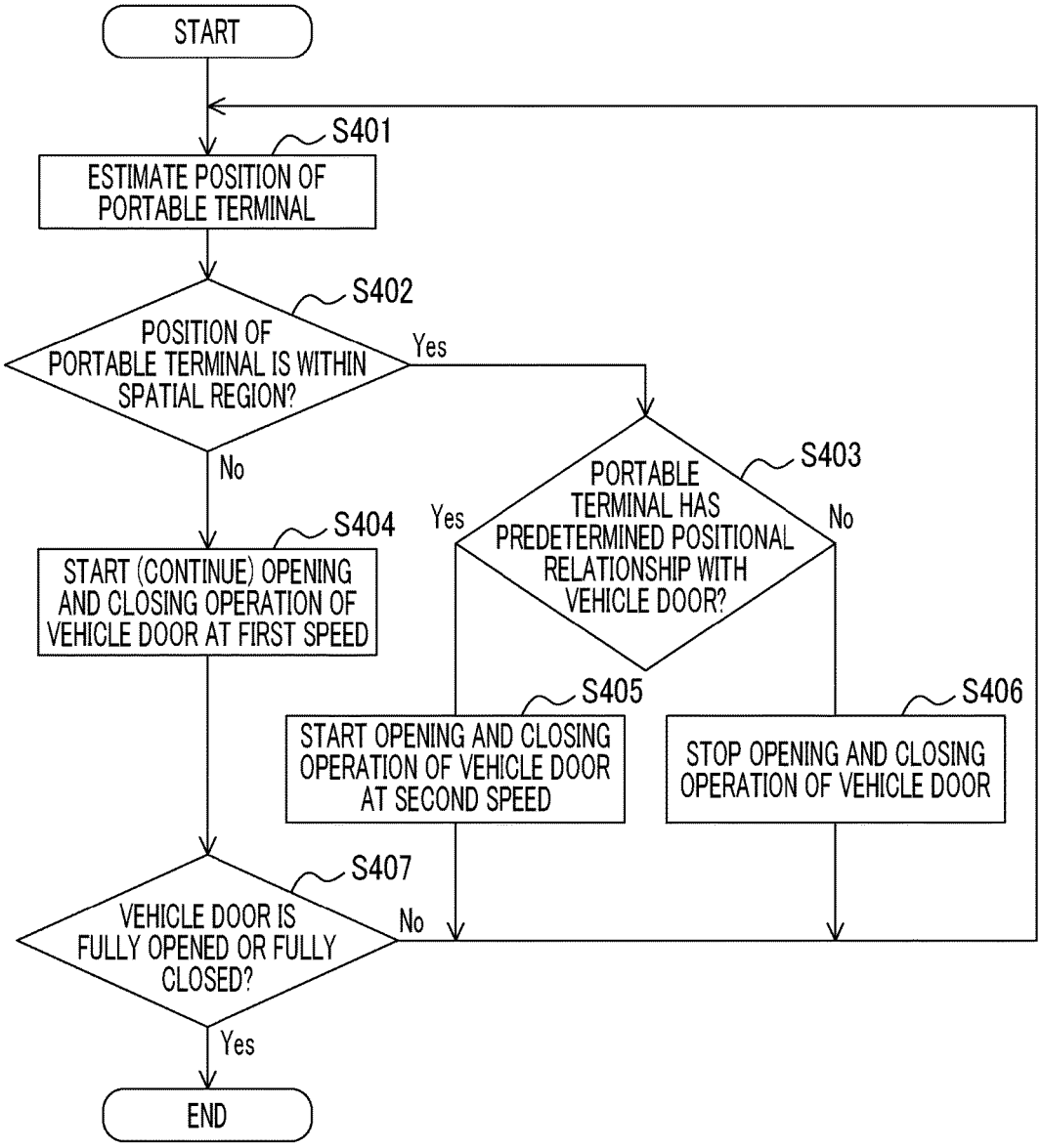
FIG. 4 is a flowchart illustrating a processing procedure of opening and closing control of a vehicle door according to Example 2.
Figure 5:
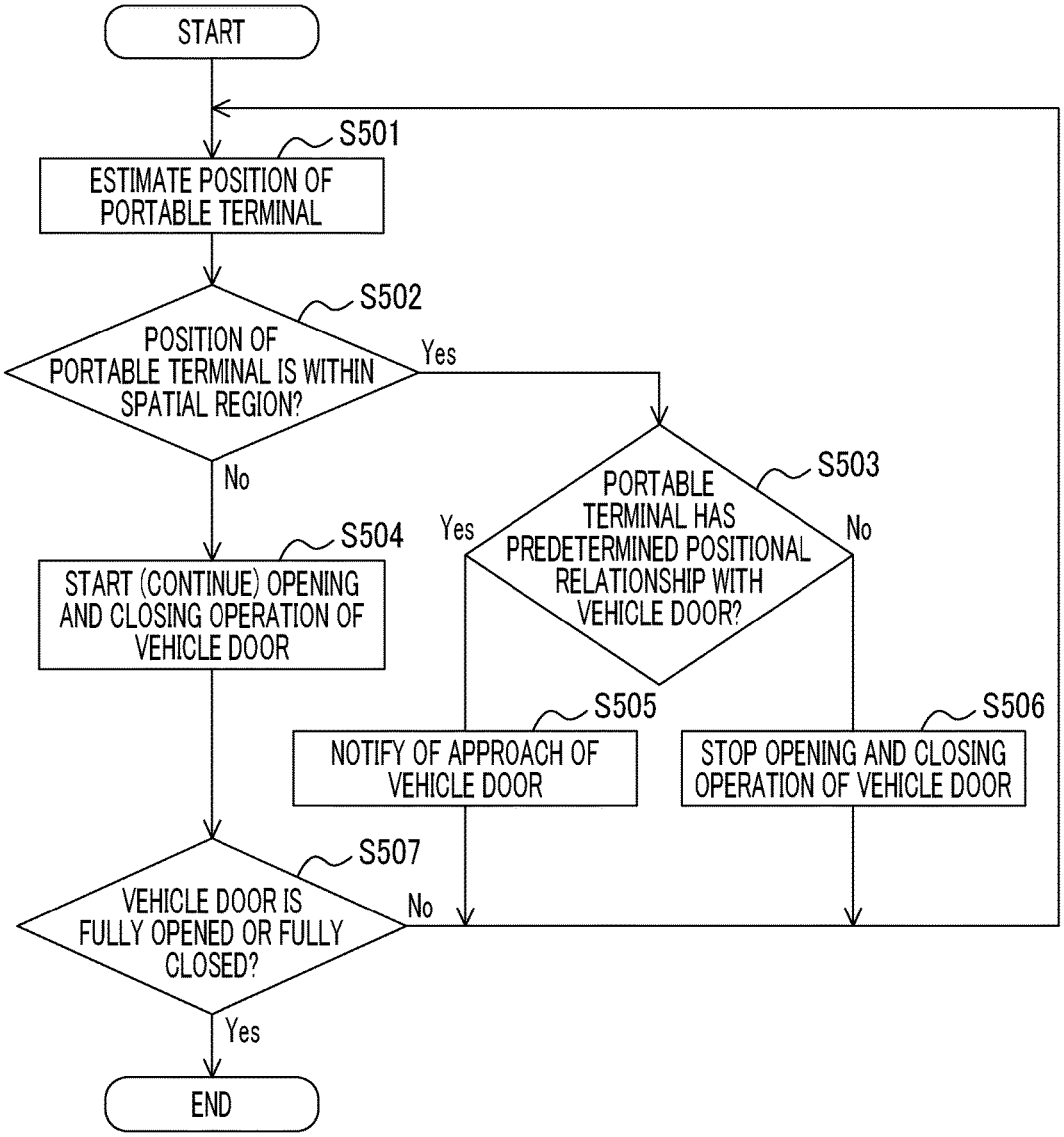
FIG. 5 is a flowchart illustrating a processing procedure of opening and closing control of a vehicle door according to Example 3.
Figure 6:
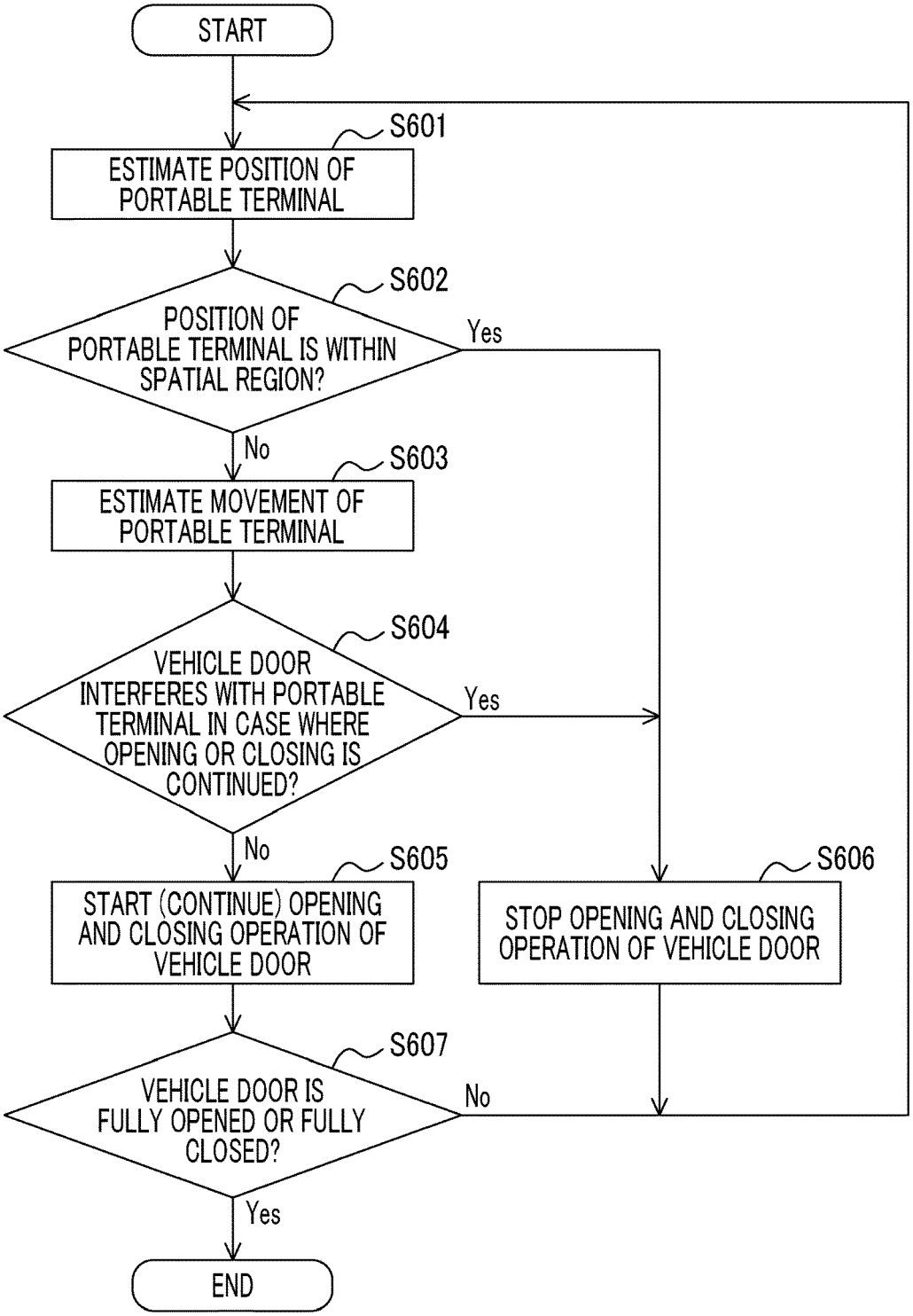
FIG. 6 is a flowchart illustrating a processing procedure of opening and closing control of a vehicle door according to Example 4.

An opening and closing control method (a vehicle control method) of the vehicle door that the vehicle control device 10 according to the embodiment of the disclosure executes will be described further referring to FIGS. 3 to 6. FIG. 3 is a flowchart illustrating opening and closing control processing of the vehicle door according to Example 1. FIG. 4 is a flowchart illustrating opening and closing control processing of a vehicle door according to Example 2. FIG. 5 is a flowchart illustrating opening and closing control processing of a vehicle door according to Example 3. FIG. 6 is a flowchart illustrating opening and closing control processing of a vehicle door according to Example 4.

For example, the opening and closing control of the vehicle door illustrated in each drawing is started in a case where the authentication of the portable terminal 20 is successful, and there is the instruction of the opening and closing operation of the vehicle door to the vehicle (for example, an operation of an opening and closing switch provided in the vehicle, command transmission from the portable terminal 20, or the like).

Example 1

(FIG. 3) Step S301: Transmission and reception using the impulse UWB signal are performed in the second communication unit 12, and the position of the portable terminal 20 is estimated by the estimation unit 13*b*. In a case where the position of the portable terminal 20 is estimated, the process progresses to Step S302.

Step S302: Determination is made by the determination unit 13*c* whether or not the estimated position of the portable terminal 20 is within the region S where the vehicle door of the vehicle passes in the opening and closing operation. In a case where the position of the portable terminal 20 is not within the region S (S302, No), the process progresses to Step S303. In a case where the position of the portable terminal 20 is within the region S (S302, Yes), the process progresses to Step S304.

Step S303: The opening and closing operation of the vehicle door is started (continued) by the controller 13*d*. In a case where the opening and closing operation of the vehicle door is started, the process progresses to Step S305.

Step S304: The opening and closing operation of the vehicle door is stopped by the controller 13*d*. In a case where the opening and closing operation of the vehicle door is stopped, the process returns to Step S301.

Step S305: Determination is made by the controller 13*d* whether the vehicle door is fully opened or fully closed. In a case where the vehicle door is fully opened or fully closed (S305, Yes), the opening and closing control of the vehicle door ends. In a case where the vehicle door is not fully opened or fully closed (S305, No), the process returns to Step S301.

In Step S304, in a case where the opening and closing operation of the vehicle door is stopped, the opening and closing control of the vehicle door may end instantly, or the opening and closing control of the vehicle door may end after lapse of a predetermined time.

In the opening and closing control of the vehicle door according to Example 1, in a case where the portable terminal 20 is at a position in contact with the vehicle door when the vehicle door is opened and closed, the opening and closing operation of the vehicle door is stopped. With this, the vehicle door in the opening and closing operation does not come into contact with the user who carries the portable terminal 20.

Example 2

(FIG. 4) Step S401: Transmission and reception using the impulse UWB signal are performed in the second communication unit 12, and the position of the portable terminal 20 is estimated by the estimation unit 13*b*. In a case where the position of the portable terminal 20 is estimated, the process progresses to Step S402.

Step S402: Determination is made by the determination unit 13*c* whether or not the estimated position of the portable terminal 20 is within the region S where the vehicle door of the vehicle passes in the opening and closing operation. In a case where the position of the portable terminal 20 is not within the region S (S402, No), the process progresses to Step S404. In a case where the position of the portable terminal 20 is within the region S (S402, Yes), the process progresses to Step S403.

Step S403: Determination is made whether or not the portable terminal 20 within the region S has a predetermined positional relationship with the vehicle door. The predetermined positional relationship represents a positional relationship where there is a given margin before the vehicle door comes into contact with the portable terminal 20, and can be defined by, for example, the distance between the vehicle door and the portable terminal 20, the time until the vehicle door and the portable terminal 20 come into contact with each other, or the like. In a case where the vehicle door and the portable terminal 20 have the predetermined positional relationship (S403, Yes), the process progresses to Step S405. In a case where the vehicle door and the portable terminal 20 do not have the predetermined positional relationship (S403, No), the process progresses to Step S406.

Step S404: The opening and closing operation of the vehicle door is started (continued) at a predetermined first speed by the controller 13*d*. In a case where the opening and closing operation of the vehicle door is started at the first speed, the process progresses to Step S407.

Step S405: The opening and closing operation of the vehicle door is started at a predetermined second speed by the controller 13*d*. The second speed is set to a speed lower than the first speed. In a case where the opening and closing operation of the vehicle door is started at the second speed, the process progresses to Step S401.

Step S406: The opening and closing operation of the vehicle door is stopped by the controller 13*d*. In a case where the opening and closing operation of the vehicle door is stopped, the process returns to Step S401.

Step S407: Determination is made by the controller 13*d* whether or not the vehicle door is fully opened or fully closed. In a case where the vehicle door is fully opened or fully closed (S407, Yes), the opening and closing control of the vehicle door ends. In a case where the vehicle door is not fully opened or fully closed (S407, No), the process returns to Step S401.

In the opening and closing control of the vehicle door according to Example 2, in a case where the portable terminal 20 is within the region S and has the predetermined positional relationship with the vehicle door, the opening and closing operation of the vehicle door is performed at the second speed lower than the first speed of opening and closing in a state in which the portable terminal 20 is not within the region S. For this reason, it is possible to give a lot of time for avoiding the approaching vehicle door to the user who carries the portable terminal 20. With this, it is possible to suppress the contact of the vehicle door in the opening and closing operation with the user who carries the portable terminal 20.

Example 3

(FIG. 5) Step S501: Transmission and reception using the impulse UWB signal are performed in the second communication unit 12, and the position of the portable terminal 20 is estimated by the estimation unit 13*b*. In a case where the position of the portable terminal 20 is estimated, the process progresses to Step S502.

Step S502: Determination is made by the determination unit 13*c* whether or not the estimated position of the portable terminal 20 is within the region S where the vehicle door of the vehicle passes in the opening and closing operation. In a case where the position of the portable terminal 20 is not within the region S (S502, No), the process progresses to Step S504. In a case where the position of the portable terminal 20 is within the region S (S502, Yes), the process progresses to Step S503.

Step S503: Determination is made whether or not the portable terminal 20 within the region S has a predetermined positional relationship with the vehicle door. The predetermined positional relationship represents a positional relationship where there is a given margin before the vehicle door comes into contact with the portable terminal 20, and can be defined by, for example, the distance between the vehicle door and the portable terminal 20, the time until the vehicle door and the portable terminal 20 come into contact with each other, or the like. In a case where the vehicle door and the portable terminal 20 have the predetermined positional relationship (S503, Yes), the process progresses to Step S505. In a case where the vehicle door and the portable terminal 20 do not have the predetermined positional relationship (S503, No), the process progresses to Step S506.

Step S504: The opening and closing operation of the vehicle door is started (continued) by the controller 13*d*. In a case where the opening and closing operation of the vehicle door is started, the process progresses to Step S507.

Step S505: The approach of the vehicle door toward the user is notified by the controller 13*d*. The notification may be performed through a notification unit (not shown) mounted in the vehicle, or the portable terminal 20 may be instructed to perform the notification. For the notification, means, such as sound output from a speaker, lighting/blinking (hazard or the like) of a light or a lamp, or vibration by a vibrator, can be used. In a case where the approach of the vehicle door is notified, the process returns to Step S501.

Step S506: The opening and closing operation of the vehicle door is stopped by the controller 13*d*. In a case where the opening and closing operation of the vehicle door is stopped, the process returns to Step S501.

Step S507: Determination is made by the controller 13*d* whether or not the vehicle door is fully opened or fully closed. In a case where the vehicle door is fully opened or fully closed (S507, Yes), the opening and closing control of the vehicle door ends. In a case where the vehicle door is not fully opened or fully closed (S507, No), the process returns to Step S501.

The notification in Step S505 may be performed continuously until the portable terminal 20 is not within the region S, or may be performed only for a predetermined time.

In the opening and closing control of the vehicle door according to Example 3, in a case where the portable terminal 20 is within the region S and has the predetermined positional relationship with the vehicle door, the notification is performed to alert the user that the portable terminal 20 is at the position in contact with the vehicle door in the opening and closing operation. With this, it is possible to suppress the contact of the vehicle door in the opening and closing operation with the user who carries the portable terminal 20.

Example 4

(FIG. 6) Step S601: Transmission and reception using the impulse UWB signal are performed in the second communication unit 12, and the position of the portable terminal 20 is estimated by the estimation unit 13*b*. In a case where the position of the portable terminal 20 is estimated, the process progresses to Step S602.

Step S602: Determination is made by the determination unit 13*c* whether or not the estimated position of the portable terminal 20 is within the region S where the vehicle door of the vehicle passes in the opening and closing operation. In a case where the position of the portable terminal 20 is not within the region S (S602, No), the process progresses to Step S603. In a case where the position of the portable terminal 20 is within the region S (S602, Yes), the process progresses to Step S606.

Step S603: The movement of the portable terminal 20 is estimated by the estimation unit 13*b*. In a case where the movement of the portable terminal 20 is estimated, the process progresses to Step S604.

Step S604: Determination is made by the determination unit 13*c* whether or not the movement of the vehicle door of which opening and closing operation is started by the controller 13*d* interferes with the movement of the portable terminal 20 based on the estimated movement of the portable terminal 20 and the movement (opening and closing direction) of the vehicle door. In a case where the movement of the vehicle door and the movement of the portable terminal 20 do not interfere with each other (S604, No), the process progresses to Step S605. In a case where the movement of the vehicle door and the movement of the portable terminal 20 do not interfere with each other (S604, Yes), the process progresses to Step S606.

Step S605: In a case where the opening and closing operation of the vehicle door is started (continued) by the controller 13*d*. In a case where the opening and closing operation of the vehicle door is started, the process progresses to Step S607.

Step S606: The opening and closing operation of the vehicle door is stopped by the controller 13*d*. In a case where the opening and closing operation of the vehicle door is stopped, the process returns to Step S601.

Step S607: Determination is made by the controller 13*d* whether or not the vehicle door is fully opened or fully closed. In a case where the vehicle door is fully opened or fully closed (S607, Yes), the opening and closing control of the vehicle door ends. In a case where the vehicle door is not fully opened or fully closed (S607, No), the process returns to Step S601.

In Step S606, in a case where the opening and closing operation of the vehicle door is stopped, the opening and closing control of the vehicle door may end instantly, or the opening and closing control of the vehicle door may end after lapse of a predetermined time.

In the opening and closing control of the vehicle door according to Example 4, in a case where the user is at a position in contact with the vehicle door when the vehicle door is opened and closed, the opening and closing operation of the vehicle door is stopped. Even in a case where the user is not at the position in contact with the vehicle door when the vehicle door is opened and closed, when determination is made that the movement of the vehicle door and the movement of the portable terminal 20 interfere with each other, the opening and closing operation of the vehicle door is stopped. With this, the vehicle door in the opening and closing operation is not in contact with the user who carries the portable terminal.

Operation and Effects in Embodiment

With the vehicle control device 10 according to the embodiment of the disclosure described above, for example, the position of the portable terminal 20 present around the vehicle is estimated using impulse UWB communication capable of performing distance measurement with high accuracy. When the vehicle door is automatically opened and closed, in a case where the portable terminal 20 is not within the region S where the vehicle door passes in the opening and closing operation, that is, in a case where determination can be made with high probability that the user who carries the portable terminal 20 is not within the region S, the opening and closing operation of the vehicle door is performed.

With the control, it is possible to suppress the contact of the vehicle door in the opening and closing operation with the user who carries the portable terminal 20.

With the vehicle control device 10 according to the embodiment, in a case where determination is made that the portable terminal 20 is within the region S, that is, in a case where determination can be made that the user who carries the portable terminal 20 is at a position in contact with the vehicle door, the opening and closing operation of the vehicle door can be performed at a speed (second speed) lower than in a case determination is made that the portable terminal 20 is not within the region S, and predetermined notification can be performed through the notification unit mounted in the vehicle or the portable terminal 20.

In the former case, even though the user is within the region S at the time of the start of the opening and closing operation of the vehicle door, the user who notices the approach of the vehicle door during the opening and closing operation can take action needed for avoiding the contact with the vehicle door with sufficient time. In the latter case, it is possible to alert the user that the user is at a position in contact with the vehicle door in the opening and closing operation, and to allow the user to take action for avoiding the contact with the vehicle door. Accordingly, it is possible to suppress the contact of the vehicle door in the opening and closing operation with the user who carries the portable terminal 20.

With the vehicle control device 10 according to the embodiment, the movement of the portable terminal 20 is estimated based on time-dependent change in the position of the portable terminal 20, determination is made whether or not the movement of the vehicle door of which opening and closing operation is started interferes with the movement of the estimated portable terminal 20, and in a case where determination is made that the movement of the vehicle door and the movement of the portable terminal 20 interfere with each other, it is possible to stop the opening and closing operation of the vehicle door.

With the control, in a period from the start of the opening and closing operation of the vehicle door to the completion thereof, for example, the opening and closing direction of the vehicle door and the moving direction of the user have an intersection relationship, and in a case where the user who carries the portable terminal 20 and the vehicle door interfere with each other, it is possible to stop the opening and closing operation of the vehicle door. The intersecting relationship between the opening and closing direction of the vehicle door and the moving direction of the user is, for example, the relationship between a direction of opening the right door of the vehicle and the user who moves from the right side in front of the vehicle toward the right door or the relationship between a direction of closing the right door of the vehicle and the user who moves from the right side behind the vehicle toward the right door. Accordingly, it is possible to suppress the contact of the user who carries the portable terminal 20 with the vehicle door in the opening and closing operation.

The vehicle control device of the disclosure is usable for a vehicle or the like capable of making a vehicle door be automatically opened and closed.

What is claimed is:

1. A vehicle control device that controls automatic opening and closing of a vehicle door, the vehicle control device comprising:

an estimation unit configured to estimate a position of a portable terminal that is authenticated by a vehicle through predetermined communication;

a determination unit configured to determine whether the position of the portable terminal estimated by the estimation unit is within a region where the vehicle door passes in an opening or closing operation; and a controller configured to, when door opening or door closing of the vehicle door is instructed, in a case where the determination unit determines that the position of the portable terminal is not within the region, execute the opening or closing operation of the vehicle door.

2. The vehicle control device according to claim 1, wherein the controller is configured to, when door opening or door closing of the vehicle door is instructed, in a case where the determination unit determines that the position of the portable terminal is within the region and has a predetermined positional relationship with the vehicle door, execute the opening or closing operation of the vehicle door at a speed lower than in a case where the determination unit determines that the position of the portable terminal is not within the region.

3. The vehicle control device according to claim 2, wherein the predetermined positional relationship is a positional relationship where there is a given margin before the vehicle door comes into contact with the portable terminal.

4. The vehicle control device according to claim 1, wherein the controller is configured to, when door opening or door closing of the vehicle door is instructed, in a case where the determination unit determines that the position of the portable terminal is within the region and has a predetermined positional relationship with the vehicle door, perform predetermined notification through a notification unit mounted in the vehicle.

5. The vehicle control device according to claim 1, wherein the controller is configured to, when door opening or door closing of the vehicle door is instructed, in a case where the determination unit determines that the position of the portable terminal is within the region and has a predetermined positional relationship with the vehicle door, instruct the portable terminal to perform predetermined notification.

6. The vehicle control device according to claim 1, wherein:

the estimation unit is configured to further estimate movement of the portable terminal based on time-dependent change in the position of the portable terminal;

the determination unit is configured to further determine whether movement of the vehicle door of which opening or closing operation is started by the controller interferes with the movement of the portable terminal estimated by the estimation unit; and the controller is configured to, in a case where the determination unit determines that the movement of the vehicle door and the movement of the portable terminal interfere with each other, stop the opening or closing operation of the vehicle door.

7. The vehicle control device according to claim 1, further comprising:

a first communication unit configured to perform communication with the portable terminal for authentication of the portable terminal, transmit a request signal requesting for response signal transmission from the portable terminal through low frequency communication, and receive a response signal transmitted from the portable terminal through radio frequency communication; and a second communication unit configured to perform communication with the portable terminal for estimation of the position of the portable terminal, and measure a distance between the second communication unit and the portable terminal through ultra-wide-band communication.

8. The vehicle control device according to claim 1, wherein all or a part of the estimation unit, the determination unit, and the controller is constituted by an electronic control unit.

9. A vehicle control method executed by a vehicle control device that controls automatic opening and closing of a vehicle door, the vehicle control method comprising:

estimating a position of a portable terminal that is authenticated by a vehicle through predetermined communication;

determining whether the estimated position of the portable terminal is within a region where the vehicle door passes in an opening or closing operation; and when door opening or door closing of the vehicle door is instructed, in a case where determination is made that the position of the portable terminal is not within the region, executing the opening or closing operation of the vehicle door.

10. The vehicle control method according to claim 9, wherein, when door opening or door closing of the vehicle door is instructed, in a case where determination is made that the position of the portable terminal is within the region and has a predetermined positional relationship with the vehicle door, the opening or closing operation of the vehicle door is executed at a speed lower than in a case where determination is made that the position of the portable terminal is not within the region.

11. The vehicle control method according to claim 9, wherein, when door opening or door closing of the vehicle door is instructed, in a case where determination is made that the position of the portable terminal is within the region and has a predetermined positional relationship with the vehicle door, predetermined notification is performed.

12. The vehicle control method according to claim 9, wherein, when door opening or door closing of the vehicle door is instructed, in a case where determination is made that the position of the portable terminal is within the region and has a predetermined positional relationship with the vehicle door, the portable terminal is instructed to perform predetermined notification.

13. The vehicle control method according to claim 9, further comprising:

estimating movement of the portable terminal based on time-dependent change in the position of the portable terminal;

determining whether movement of the vehicle door of which opening or closing operation is started interferes with the estimated movement of the portable terminal; and in a case where determination is made that the movement of the vehicle door and the movement of the portable terminal interfere with each other, stopping the opening or closing operation of the vehicle door.

* * * * *